US010124982B1

(12) United States Patent
Rhoads et al.

(10) Patent No.: US 10,124,982 B1
(45) Date of Patent: Nov. 13, 2018

(54) SYSTEM AND APPARATUS FOR WIRE AND CABLE PACKAGING AND PAYOFF

(71) Applicant: ENCORE WIRE CORPORATION, McKinney, TX (US)

(72) Inventors: John L. Rhoads, McKinney, TX (US); William T. Bigbee, Jr., Melissa, TX (US); Troy D. Skidmore, McKinney, TX (US); Karolina Zuraw, Richardson, TX (US)

(73) Assignee: Encore Wire Corporation, McKinney, TX (US)

( * ) Notice: Subject to any disclaimer, the term of this patent is extended or adjusted under 35 U.S.C. 154(b) by 169 days.

(21) Appl. No.: 14/731,021

(22) Filed: Jun. 4, 2015

Related U.S. Application Data

(60) Provisional application No. 62/007,797, filed on Jun. 4, 2014.

(51) Int. Cl.
*B65H 49/20* (2006.01)

(52) U.S. Cl.
CPC ..... *B65H 49/205* (2013.01); *B65H 2701/34* (2013.01)

(58) Field of Classification Search
CPC .... B65H 49/08; B65H 49/205; B65H 55/046; B65H 2701/34; B65D 85/04
See application file for complete search history.

(56) References Cited

U.S. PATENT DOCUMENTS 1,936,227 A * 11/1933 Cook ..... B65D 85/04 229/126
2,634,922 A * 4/1953 Taylor, Jr. ..... B65D 85/04 242/163
2,716,008 A * 8/1955 Taylor, Jr. ..... B65H 49/08 242/157 R
2,738,145 A * 3/1956 Taylor, Jr. ..... B65D 85/04 242/163
3,390,844 A * 7/1968 Dillow ..... B21C 47/20 206/395
3,406,817 A * 10/1968 Feaster ..... B21C 47/28 206/408
3,853,223 A * 12/1974 Nowlain ..... B65D 85/04 206/403

(Continued)

OTHER PUBLICATIONS

Southwire Company, "Southwire's SIMpull® CoilPAK™ Payoff Revolutionizes the Construction Process", News Release, Mar. 28, 2013.

(Continued)

*Primary Examiner* — Michael E Gallion
(74) *Attorney, Agent, or Firm* — Warren Rhoades LLP

(57) ABSTRACT

An apparatus for the transportation and payoff of coiled wire and cable, the apparatus comprising a clamshell package, an inner void formed by the clamshell package, the inner void comprising a compartment within for containing coiled wire and cable during transportation and payoff of the wire and cable, a payoff port is coupled to the clamshell package, wherein the coiled wire and cable is extracted from the clamshell package through the payoff port on an axis substantially similar to the axis of the extracted wire and cable, and wherein the payoff port extends from the clamshell package through the coiled wire and cable.

19 Claims, 6 Drawing Sheets

(56) References Cited

U.S. PATENT DOCUMENTS 3,982,712 A * 9/1976 Bassett ..... B65D 85/04 206/395
4,664,260 A * 5/1987 Stokes ..... B65D 85/04 108/53.1
5,201,419 A * 4/1993 Hayes ..... B65D 85/676 206/389
5,413,264 A 5/1995 Kotzur et al.
5,470,026 A 11/1995 Kotzur
5,529,186 A * 6/1996 Bass ..... B65D 85/04 206/395
5,678,778 A 10/1997 Kotzur et al.
5,803,394 A 9/1998 Kotzur et al.
5,810,272 A 9/1998 Wallace et al.
5,979,812 A * 11/1999 Kotzur ..... B65H 57/12 206/409
6,016,911 A * 1/2000 Chen ..... B65D 5/46024 206/395
6,086,012 A 7/2000 Kotzur et al.
6,109,554 A 8/2000 Kotzur et al.
6,341,741 B1 1/2002 Kotzur et al.
6,491,163 B1 * 12/2002 Grcic ..... B65D 85/676 206/403
6,702,213 B2 3/2004 Kotzur et al.
6,766,627 B2 7/2004 Kotzur et al.
7,007,799 B2 * 3/2006 Cote ..... B65D 5/18 206/389
7,032,854 B2 * 4/2006 Marsden ..... H02G 11/02 242/388.1
7,100,346 B2 9/2006 Kotzur et al.
D541,145 S 4/2007 Copp
7,198,151 B1 * 4/2007 Fomby ..... A45C 5/08 206/303
7,249,726 B2 7/2007 Kotzur
8,006,840 B2 * 8/2011 Babcock ..... B65H 55/046 206/395
8,191,337 B2 6/2012 Moore
8,251,212 B2 * 8/2012 Dunlap ..... B65D 85/04 206/403
8,783,601 B1 * 7/2014 Shala ..... A47K 10/16 242/596.8
8,794,438 B2 8/2014 Copp et al.
8,944,358 B2 * 2/2015 Copp ..... B65H 55/046 206/409
8,960,431 B2 * 2/2015 Copp ..... B65D 85/04 206/395
9,027,313 B2 5/2015 Copp et al.
9,061,814 B2 * 6/2015 Copp ..... B65D 85/04
2004/0026284 A1 * 2/2004 Cote ..... B65D 5/18 206/397
2006/0196989 A1 * 9/2006 Bartley ..... B65H 49/08 242/601
2007/0075171 A1 * 4/2007 Babcock ..... B65H 55/046 242/170
2009/0020569 A1 * 1/2009 Young ..... D04B 3/06 223/107
2009/0057459 A1 * 3/2009 Fabian ..... B65H 49/08 242/171
2010/0320310 A1 * 12/2010 McManus ..... B65D 5/5052 242/588.3
2013/0001238 A1 * 1/2013 Burke ..... B23K 9/1333 220/729
2013/0146696 A1 * 6/2013 Copp ..... B65H 75/28 242/164
2014/0061361 A1 * 3/2014 Marble ..... A47F 13/04 242/588.6
2014/0158802 A1 * 6/2014 Batchelder ..... B65H 49/02 242/163
2014/0262891 A1 * 9/2014 Babcock ..... B65D 85/04 206/409
2014/0326624 A1 * 11/2014 Copp ..... B65D 85/04 206/303
2014/0326625 A1 * 11/2014 Copp ..... B65D 85/04 206/303

OTHER PUBLICATIONS

Southwire Company, "Southwire's SIMpull® CoilPAK™ Payoff Earns NECA Showstopper Award, the Latest Honor for Revolutionizing the Construction Process", News Release, Oct. 23, 2013.
Southwire Company, "SIMpull CoilPAK Payoff", product insert, 2013.

* cited by examiner

SYSTEM AND APPARATUS FOR WIRE AND CABLE PACKAGING AND PAYOFF

CROSS-REFERENCE TO RELATED APPLICATIONS

This application claims the benefit of U.S. Provisional Application No. 62/007,797 filed on Jun. 4, 2014, of which the entirety is incorporated herein by reference.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The present invention relates in general to electrical wire and cable, and more particularly, to electrical wire and cable packaging.

2. Description of Related Art

Wooden reels or plastic spools are common in the wire and cable industry for winding circuit-size wire. Once wound, the reels and spools are distributed to customers and jobsites. These reels and spools are cumbersome and difficult to carry due to a lack of a handle. In wet conditions, wooden reels act as wicks, absorbing water, and becoming heavier. The reels and spools are prone to damage, such as splintering or shattering, if dropped by the customer. On these reels and spools, the wire is removed or paid off in a last on/first off format. If wire is being paid off of a damaged reel or spool, the wire or cable may become tangled or damaged by the damaged reel or spool. Reels and spools often require jack stands and a shaft to support the reel or spool during pay-off. The customer must transport and use this additional equipment when dispensing wire or cable from the reel or spool. Additional pulling force is also needed to rotate the entire weight of the reel and its contents during payoff. During payoff, the inertia of the reel or spool may cause the reel or spool to continue to rotate after pulling has ceased, causing "overruns" which increase the risk of tangles and snags and additional damage to the wire or cable.

One prior art solution was developed by a company called Reelex Packaging Solutions. Reelex holds the rights for the use of a special winding technology that allows coils of wire to be paid-off without a spool or reel and without twists and tangles. Pursuant to the Reelex technology, the wire or cable is wound in a FIG. 8 formation with an embedded payoff tube. The wire is pulled from the inner diameter of the coil, rather than the outer diameter. The coil does not need to move or spin during payoff. Packaging of the Reelex technology typically includes the use of cardboard boxes and/or shrink-wrap.

Another prior art solution was developed by Southwire Company and is described in U.S. Patent Application Publication No. US 2014/0131505. In the Southwire Company solution, a package is developed with a chamber, the package designed to lie on its side. The chamber is an o-ring shape with a cylindrical void in the center. A continuous opening is provided along the entire edge of the cylindrical void allowing the wire to be pulled from the edge of the void as the wire travels circumferentially along the cylindrical void. This solution still requires that the wire be pulled across the wound wire and at an angle perpendicular to the intended path of the wire payoff direction. Therefore, a need exists for a wire and cable packaging and payoff system and apparatus that provides a wire and cable payoff in substantially the same axis as the intended wire and cable path with reduced pulling force and reduced equipment and reduced costs.

SUMMARY OF THE INVENTION

The invention provides for a system and apparatus for improved wire and cable packaging and payoff. The wire or cable is coiled in a FIG. 8 pattern and includes an embedded payoff port. The system and apparatus allow the wire to be pulled from the inner diameter of the core rather than the outer diameter along substantially the same axis as the direction of the payoff wire and cable. The coil does not need to move to pay-off and therefore pulling force is minimal. The packaging used to contain the coils eliminates the possibility of tangles or overruns.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

DESCRIPTION OF THE PREFERRED EMBODIMENT

Figure 1:
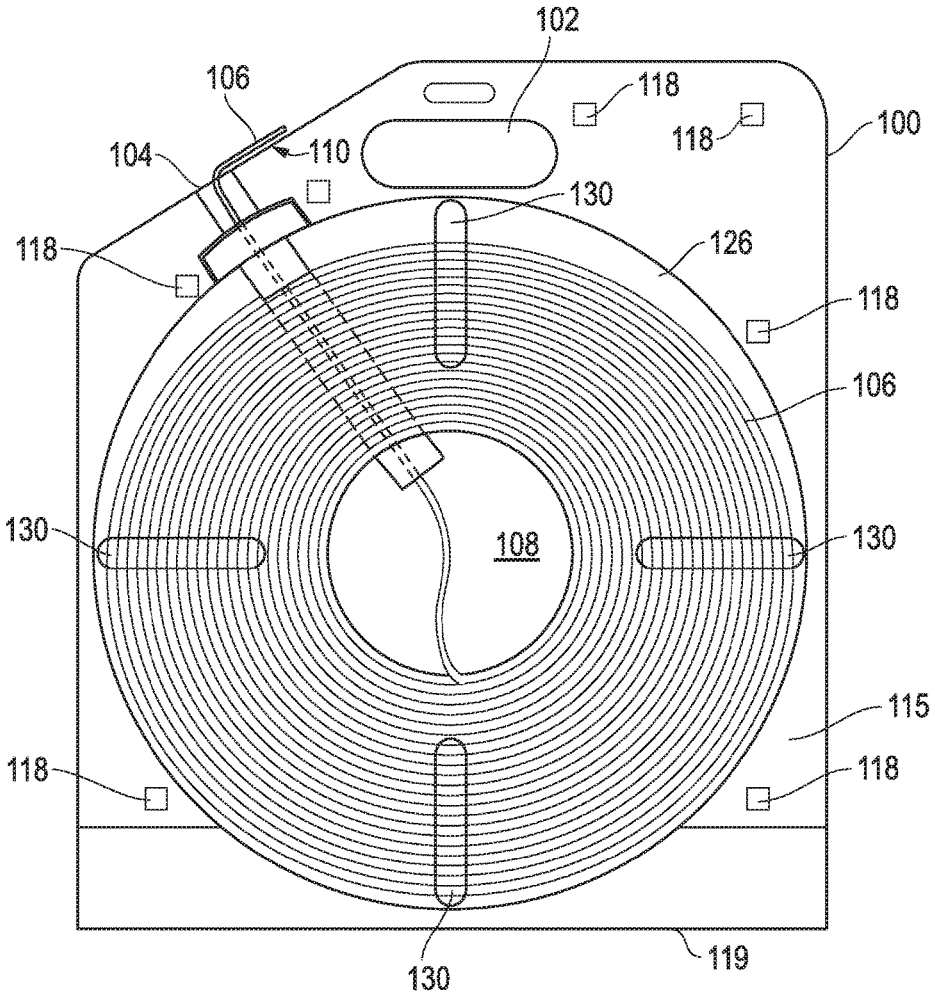
FIG. 1 is a side view of an exemplary wire and cable package and payoff apparatus.
Figure 2:
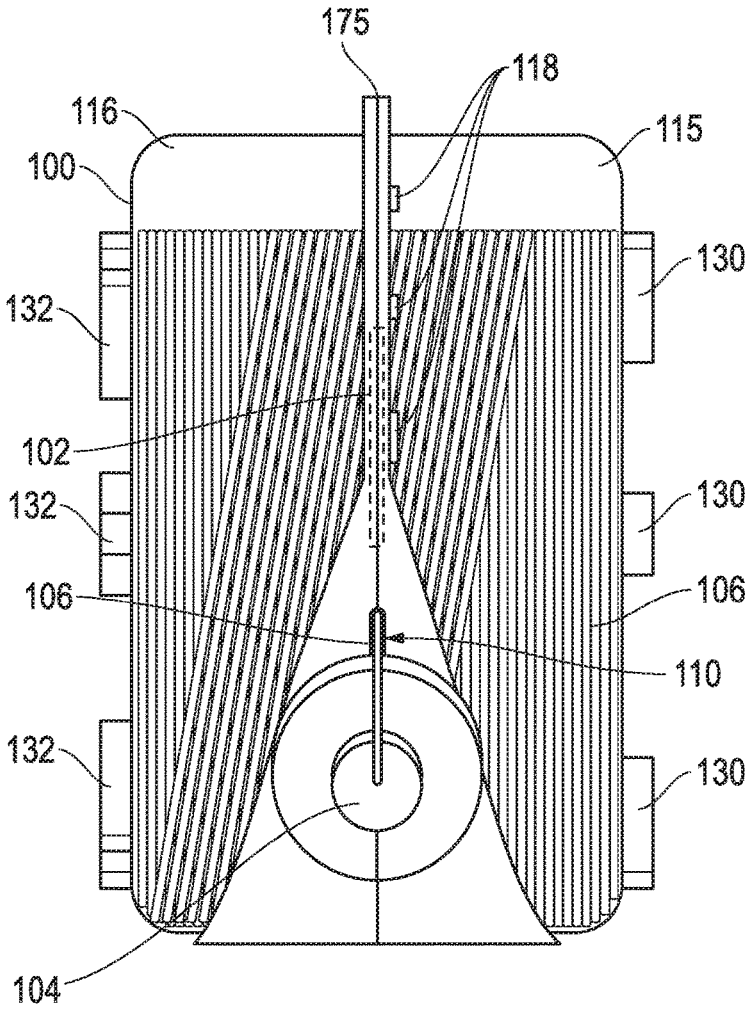
FIG. 2 is a top view of an exemplary wire and cable package and payoff apparatus.
Figure 3:
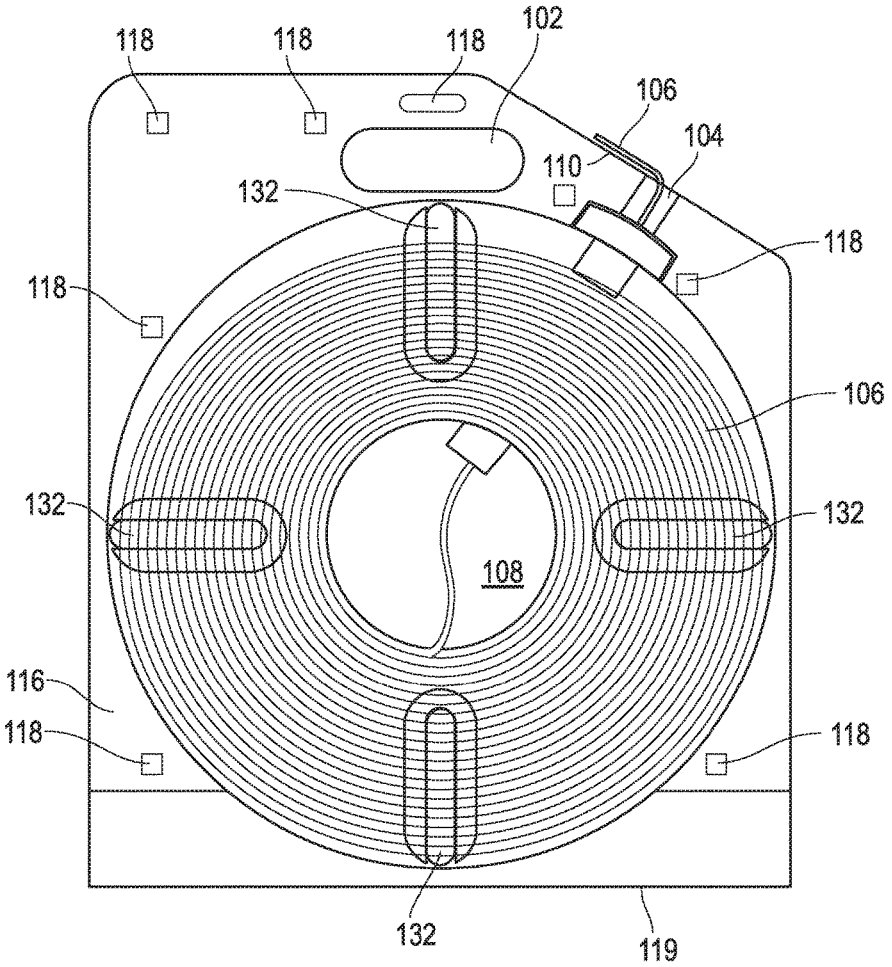
FIG. 3 is a side view of an exemplary wire and cable package and payoff apparatus.
Figure 4:
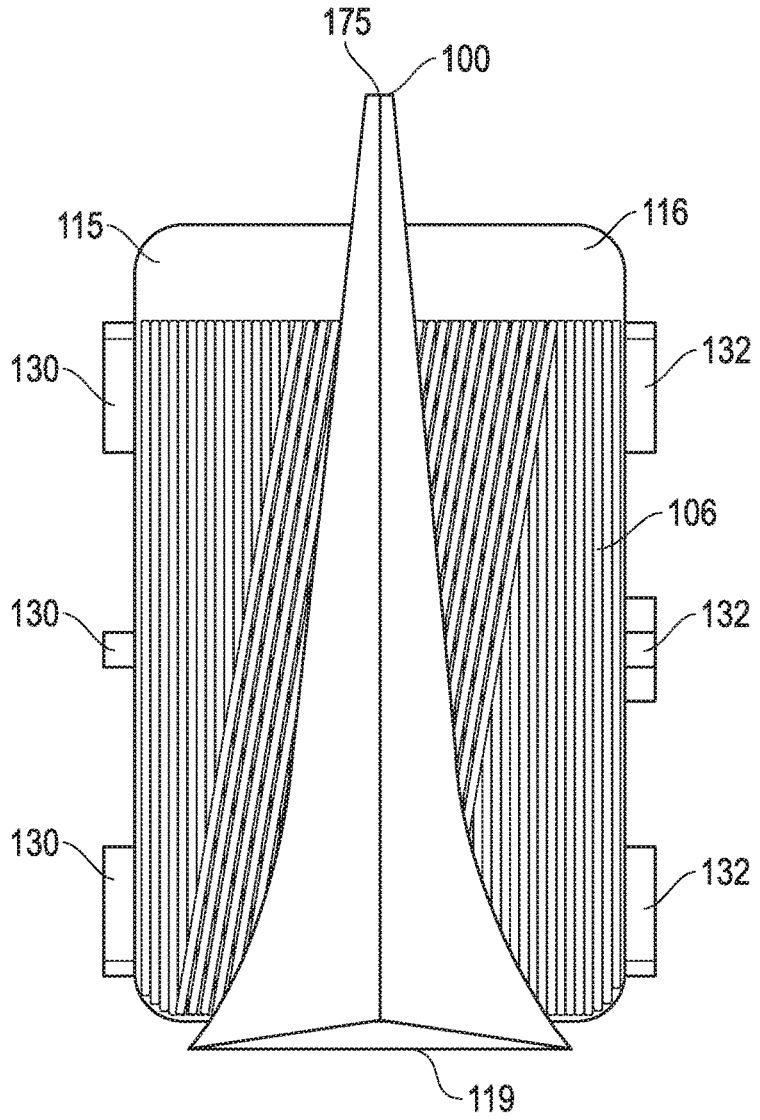
FIG. 4 is an opposite side view of an exemplary wire and cable package and payoff apparatus.
Figure 5:
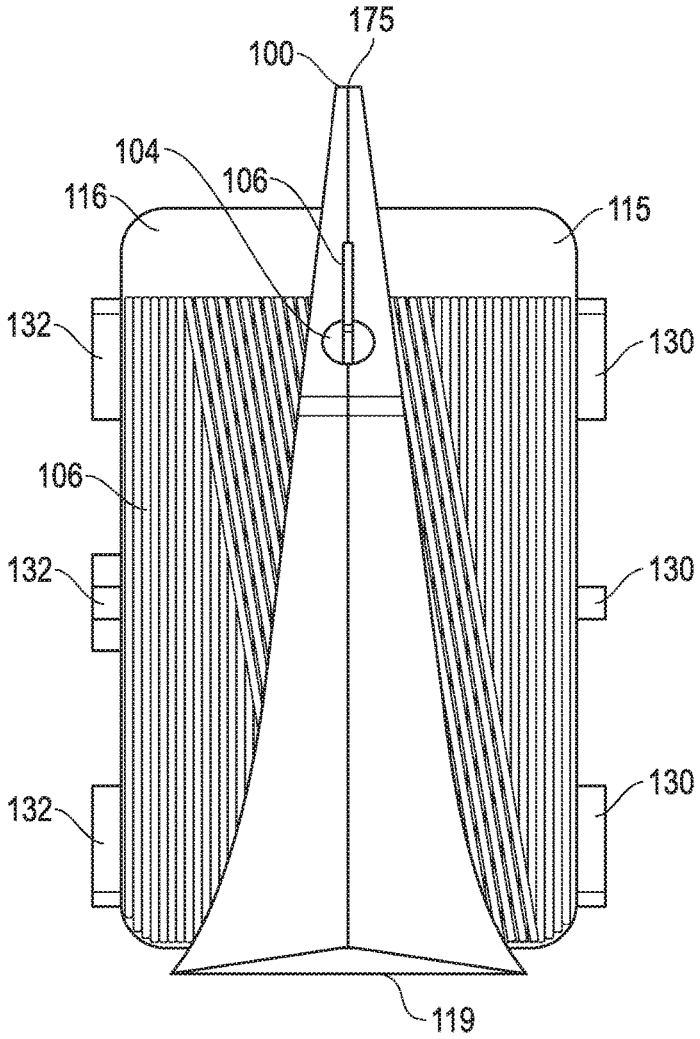
FIG. 5 is a top view of an exemplary wire and cable package and payoff apparatus.
Figure 6:
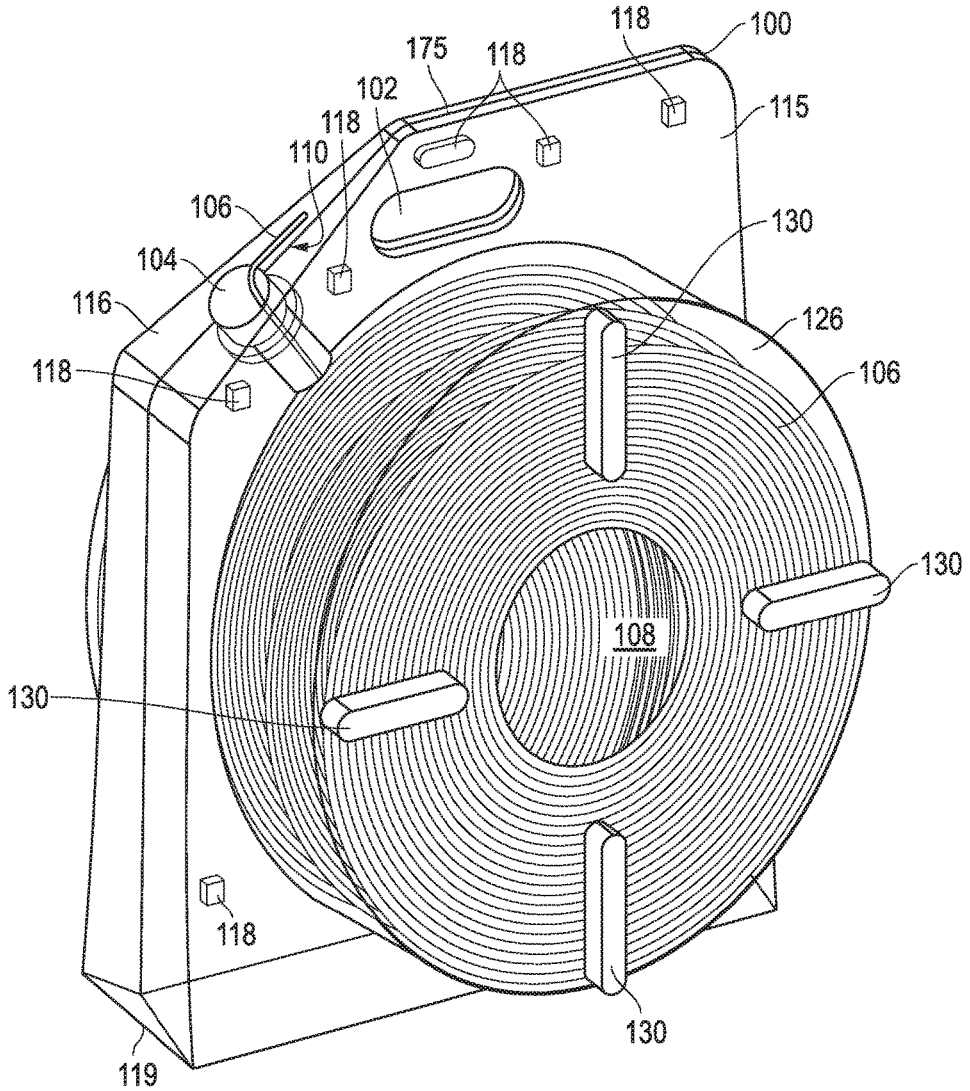
FIG. 6 is a back view of an exemplary wire and cable package and payoff apparatus.

Referring now to FIGS. 1-6, an exemplary wire and cable package and payoff apparatus is shown. A wire and cable package 100 for transporting and paying off wire and cable 106 is shown. In one embodiment, the wire and cable 106 is coiled in a FIG. 8 coil pattern while the wire and cable package 100 itself is made in the form of a clamshell configuration. The clamshell configuration is connected at the top of the wire and cable package 100 and is fastenably connected at the top, sides and bottom of the wire and cable package 100. In one disclosed embodiment, the halves of the clamshell 115 and 116 are fastened together with a standard interlocking snap feature or adhesive. The wire and cable package 100 may be closed and fastened with a single fastening device or by multiple fastening devices 118 located throughout the wire and cable package 100. The fastening adhesion prevents the halves 115 and 116 from opening even after the wire and cable package 100 is dropped. The wire and cable package 100 may be permanently connected after assembly. In one embodiment, the wire and cable package 100 is fastened 118 on the sides and bottom and the top edge of the wire and cable package 100. The halves 115 and 116 are coupled through a folding edge 175 on the top of the wire and cable package 100. The wire and cable package 100 is made from a variety of material, including plastic, thermoplastic, and polyvinyl chloride, also known as PVC. A wide variety of materials made be used in the formation of the package without detracting from the spirit of the invention, including the use of recycled materials. The wire and cable package 100 may be formed from a single continuous piece of material or may be formed by multiple distinct and separate pieces of material which are fastened or attached to each other to form the wire and cable package 100. In one embodiment, the wire and cable package 100 is transparent or substantially transparent. Substantially transparent is defined as the level of transparency where an individual may ascertain the level of wire and cable present within the wire and cable package 100 under normal circumstances. The transparent package 100 allows an individual, such as a wire installer, to visually observe the remaining amount of wire during transportation and during payoff of the wire or cable. In one embodiment, markings or other indicia may be provided on the wire and cable package 100 to indicate the amount of remaining wire and cable 106. In this embodiment, the size of the outer diameter of the coiled wire and cable 106 indicates the approximate amount of wire and cable 106 remaining in the wire and cable package 100. In another embodiment, the wire and cable package 100 is water resistant, durable, and inexpensive. Water resistant is defined as the seal of the wire and cable package 100 preventing the passage of water to the coiled wire and cable unless the wire and cable package 100 is submerged in water. The wire and cable package 100, as disclosed herein, may be formed from a durable material, a material not prone to cracking, breaking, or separating, such as plastic. In one embodiment, the wire and cable package 100 material has a thickness of 0.030", however, a wide variety of material thicknesses may be used without detracting from the spirit of the invention. At this thickness, the wire and cable package 100 uses less material when compared to a wooden reel and has an overall lower weight and lower cost. The clamshell design of the wire and cable package 100 forms a flat support 119 on the bottom of the wire and cable package 100 allowing the wire and cable package 100 to stand upright during payoff of the wire and cable 106. The wire and cable package 100, when closed, forms a compartment 126 for containing a coiled wire and cable 106. When the wire and cable 106 is coiled in the compartment 126, an inner void 108 is formed. The wire and cable 106, when coiled, has an inner diameter and an outer diameter and, at the center of the coil, forms the inner void 108 or empty space. The wire and cable 106, when being paid off or pulled by the wire installer, is extracted from the inner diameter which was the first end of the wire to be coiled. The inner void 108 at the center of the coiled wire and cable 106 allows the wire to move freely during extraction.

Unlike traditional reels and spools, no additional equipment is needed to support the wire and cable package 100 during payoff. The wire and cable package 100, as disclosed herein, may stand upright on the ground or other surface and allow the payoff of the wire and cable 106 without the need of the wire and cable package 100 to rotate or spin. In one disclosed embodiment, the wire and cable package 100 is 13.5" H×12.5" W×7" D, however a wide variety of package sizes may be implemented without detracting from the spirit of the invention. In another embodiment, an external case may be provided to enclose the wire and cable package 100. The external case includes but is not limited to a cardboard case. The cardboard case may house a single wire and cable package 100 or multiple wire and cable packages 100. An opening, including but not limited to a perforated opening, is provided on the front of the external case to allow the access to the payoff port 104 and wire and cable 106. Additionally, an opening is provided on the halves 115 and 116 to allow access to the alternative wire and cable extraction point on the sides of the wire and cable package 100. Further, handles or additional openings are provided to allow for a wire puller to carry or move the external case enclosing the wire and cable package 100. Additionally, the gauge of the wire and cable 106 may vary without detracting from the spirit of the invention. In one embodiment, multiple wires may be simultaneously coiled (or coiled in parallel) and paid off with the disclosed wire and cable package 100. A handle 102 is provided within the wire and cable package 100, located in the top-center of the wire and cable package 100, allowing for a balanced lifting point and minimization of fatigue by the customer in one embodiment. The handle 102 may be formed by the clamshell sides or halves 115 and 116 or may be an additional member attached to the wire and cable package 100. The handle 102, in one embodiment, is located on the top of the wire and cable package 100, however the location of the handle may vary without detracting from the spirit of the invention. The top of the wire and cable package 100, as discussed herein, is the end opposite the flat support 119.

As seen in FIGS. 1-6, the sides or two halves 115 and 116 of the wire and cable package 100 may also include male and female protrusions 130 and 132 for stacking, either horizontally or vertically, of multiple wire and cable packages 100. The male and female protrusions 130 and 132 interconnect to attach multiple packages 100. This embodiment further assists wire pullers as wire installation usually requires multiple wires or cables 106 to be pulled into a single conduit at the same time. The wire and cable package 100 has a slot which secures a payoff port 104. The payoff port 104 extends from the outer edge of the wire and cable package 100, through the coiled wire and cable 106, to the inner void 108. The end of the coiled wire and cable 106 which formed the beginning of the coil, is pulled from the inner void 108 through the payoff port 104 and is paid off out the top of the wire and cable package 100. The angle of the payoff port 104 is approximately 45° from vertical in one embodiment, however, the exact angle may be increased or decreased without detracting from the spirit of the invention. This angle allows the coiled wire and cable 106 to be paid off at substantially the same axis as the axis of the pulled wire. Additionally, this embodiment assists the wire puller when the wire and cable package 100 is set low on the ground. The wire and cable package 100 requires no additional payoff stands or additional devices. The wire and cable contained within the wire and cable package 100 may be paid off without the need of additional machinery. The payoff port 104 may be formed as a part of the wire and cable package 100 or may be formed as a distinct piece that is attached to the wire and cable package 100. The wire and cable 106 may be coiled around the payoff port 104 or the payoff port 104 may be inserted into the coiled wire and cable 106. In one embodiment, a hole in one or both halves 115 and 116 may be provided. The hole allows an alternative wire and cable 106 extraction point. In this embodiment, the wire and cable 106 is extracted through the hole rather than the payoff port 104. In one embodiment, the hole has a 3.5 inch diameter.

A wire securement device 110 is attached to the wire and cable package 100. The wire securement device 110 secures the payoff end of the coiled wire and cable 106 during transportation and when the coiled wire and cable 106 is not being paid off. The wire securement device 110 may be formed as a part of the wire and cable package 100 or may be formed as a separate device attached to the wire and cable package 100. In one embodiment, the wire securement device 110 is a channel with a channel width less than the width of the wire and cable 106. The payoff end of the wire and cable 106 is placed or slid into the channel of the wire securement device 110 to secure the wire and cable 106. Once secured, the wire and cable 106 will not uncoil. The wire securement device 110 is simpler for the wire puller to use compared to the prior art methods of applying tape or knotting the wire and cable 106 on a traditional spool or reel.

In one embodiment, an apparatus for the transportation and payoff of coiled wire and cable is disclosed. The apparatus includes a clamshell package, a compartment formed by the clamshell package, the compartment for containing coiled wire and cable during transportation and payoff of the wire and cable, wherein an inner void is formed by the coiled wire and cable within the compartment, a payoff port coupled to the clamshell package, wherein the coiled wire and cable is extracted from the clamshell package through the payoff port on an axis substantially similar to the axis of the extracted wire and cable, and wherein the payoff port extends from the clamshell package through the coiled wire and cable. The apparatus may be transparent and may be formed from plastic such as polyvinyl chloride or a thermoplastic. The apparatus may be formed from recycled material. In one embodiment, the apparatus material has a thickness of no more than 0.030 inches.

The apparatus may further include a first clamshell side, a second clamshell side, and a folding edge coupling the first and second clamshell sides. The apparatus may have a flat bottom edge formed by the first and second clamshell when the clamshell is in the closed position and the apparatus may rest on the flat bottom edge of the clamshell package during payoff. The apparatus may include a male protrusion on the first clamshell side and a female protrusion on the second clamshell side, wherein the male and female protrusions interact for stacking multiple apparatus.

The apparatus may include an interlocking fastener coupled to the first and second clamshell sides, the interlocking fastener securing the first clamshell side to the second clamshell side. The interlocking fastener including at least two interlocking fasteners, a snap fastener, or a permanent fastener. The apparatus may be water resistant when in closed position and include a handle coupled to the clamshell package. The handle may be located on the top of the apparatus and adjacent to the payoff port. The apparatus may further include a wire slot coupled to the clamshell package, wherein the wire slot secures an end of the wire and cable contained within the inner void.

Although the invention is described herein with reference to specific embodiments, various modifications and changes can be made without departing from the scope of the invention as set forth in the claims below. Accordingly, the specification and figures are to be regarded in an illustrative rather than a restrictive sense, and all such modifications are intended to be included within the scope of the invention. Any benefits, advantages, or solutions to problems that are described herein with regard to specific embodiments are not intended to be construed as a critical, required, or essential feature or element of any or all the claims.

From time-to-time, the invention is described herein in terms of these example embodiments. Description in terms of these embodiments is provided to allow the various features and embodiments of the invention to be portrayed in the context of an exemplary application. After reading this description, it will become apparent to one of ordinary skill in the art how the invention can be implemented in different and alternative environments. Unless defined otherwise, all technical and scientific terms used herein have the same meaning as is commonly understood by one of ordinary skill in the art to which this invention belongs.

The preceding discussion is presented to enable a person skilled in the art to make and use the invention. The general principles described herein may be applied to embodiments and applications other than those detailed below without departing from the spirit and scope of the invention as defined by the appended claims. The invention is not intended to be limited to the embodiments shown, but is to be accorded the widest scope consistent with the principles and features disclosed herein.

In addition, while a particular feature of the invention may have been disclosed with respect to only one of several embodiments, such feature may be combined with one or more other features of the other embodiments as may be desired. It is therefore, contemplated that the claims will cover any such modifications or embodiments that fall within the true scope of the invention.

The various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one", "one or more" or the like; and adjectives such as "conventional", "traditional", "normal", "standard", "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more", "at least", "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Unless stated otherwise, terms such as "first" and "second" are used to arbitrarily distinguish between the elements such terms describe. Thus, these terms are not necessarily intended to indicate temporal or other prioritization of such elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in the field or any related fields are intended to be within the scope of the following claims.

What is claimed is:

1. An apparatus for the transportation and payoff of coiled wire and cable, the apparatus comprising:

a clamshell package;

wherein the clamshell package further comprising: a first clamshell side; a second clamshell side; and a single folding edge connecting the first and second clamshell sides; an enclosed compartment formed by the first clamshell side and the second clamshell side, the compartment for enclosing coiled wire and cable during transportation and payoff of the wire and cable, wherein an inner void is formed by the coiled wire and cable within the compartment;

a payoff port coupled to the clamshell package, wherein the coiled wire and cable is extracted from the clamshell package through the payoff port; and wherein the payoff port extends from the clamshell package through the coiled wire and cable to the inner void.

2. The apparatus of claim 1, wherein the clamshell package is transparent.

3. The apparatus of claim 1, wherein the clamshell package is formed from plastic.

4. The apparatus of claim 3, wherein the clamshell package is formed from polyvinyl chloride.

5. The apparatus of claim 3, wherein the plastic is a thermoplastic.

6. The apparatus of claim 3, wherein the plastic is recycled material.

7. The apparatus of claim 3, wherein the plastic has a thickness of no more than 0.030 inches.

8. The apparatus of claim 1, wherein a flat support is formed by the first and second clamshell when the clamshell is in the closed position.

9. The apparatus of claim 8, wherein the apparatus rests on the flat support of the clamshell package during payoff.

10. The apparatus of claim 1 further comprising a male protrusion on the first clamshell side and a female protrusion on the second clamshell side, wherein the male and female protrusions interact for stacking multiple apparatus.

11. The apparatus of claim 1 further comprising an interlocking fastener coupled to the first and second clamshell sides, the interlocking fastener secures the first clamshell side to the second clamshell side.

12. The apparatus of claim 11, wherein the interlocking fastener comprises at least two interlocking fasteners.

13. The apparatus of claim 11, wherein the interlocking fastener is a snap fastener.

14. The apparatus of claim 11, wherein the interlocking fastener is a permanent fastener.

15. The apparatus of claim 1, wherein the clamshell package is water resistant when in closed position.

16. The apparatus of claim 1 further comprising a handle coupled to the clamshell package.

17. The apparatus of claim 16, wherein the handle is located on the top of the apparatus.

18. The apparatus of claim 17, wherein the payoff port is located adjacent to the handle.

19. The apparatus of claim 1 further comprising a wire securement device coupled to the clamshell package, wherein the wire securement device secures an end of the coiled wire and cable.

* * * * *